United States Patent [19]

Borgis et al.

[11] Patent Number: 5,048,676

[45] Date of Patent: Sep. 17, 1991

[54] PACKAGED ELECTRIC LAMP

[75] Inventors: Livio Borgis, S. Antonino di Susa, Italy; Franciscus M. Klomp, Eindhoven, Netherlands

[73] Assignee: U.S. Philips Corporation, New York, N.Y.

[21] Appl. No.: 567,500

[22] Filed: Aug. 14, 1990

[30] Foreign Application Priority Data

Aug. 25, 1989 [NL] Netherlands ..... 8902149

[51] Int. Cl.[5] ..... B65D 85/42; B65D 5/02

[52] U.S. Cl. ..... 206/45.15; 206/418; 206/806

[58] Field of Search ..... 206/418, 419, 420, 422, 206/485, 806, 45.14, 45.15

[56] References Cited

U.S. PATENT DOCUMENTS

| | | | |
|---|---|---|---|
| 690,185 | 12/1901 | Rike | 206/422 |
| 1,034,762 | 8/1912 | Brown | 206/418 |
| 1,687,859 | 10/1928 | Fontaine | 206/806 X |
| 1,896,326 | 2/1933 | Northway-Ley | 206/418 X |
| 2,139,127 | 12/1938 | Mandusky | 206/418 |
| 2,619,227 | 11/1952 | Arthur | 206/56 |
| 3,134,486 | 5/1964 | Voorhies | 206/418 |
| 3,337,033 | 8/1967 | Cote | 206/418 X |
| 3,355,011 | 11/1967 | Cilluffo | 206/419 |
| 3,568,913 | 3/1971 | Friedenthal | 206/418 X |
| 3,977,091 | 12/1976 | Burnette | 206/806 X |
| 4,194,623 | 3/1980 | Klomp et al. | 206/418 |
| 4,385,694 | 5/1983 | Klomp | 206/418 |
| 4,390,097 | 6/1983 | Klomp | 206/418 |
| 4,749,083 | 6/1988 | Growney | 206/418 |

*Primary Examiner*—Jimmy G. Foster
*Assistant Examiner*—Jacob K. Ackun, Jr.
*Attorney, Agent, or Firm*—Robert J. Kraus

[57] ABSTRACT

A cardboard strip (10) is folded around an electric lamp (1) in the direction of its axis (3), which strip has an opening (16) through which the lamp cap (4) of the lamp projects in axial direction. The cardboard strip (10) has a window (13) for inspecting the lamp vessel (2) and tongues (17, 18) bent inwards from this window, enclosing the lamp (1) laterally. The cardboard strip (10) is provided with a tag (11) having a suspension opening (12) and, possibly, a flat base (20). The lamp can then be displayed in upright and hanging position. The packing allows for visual inspection of the lamp from the front and testing of the lamp without removing it from the packing.

17 Claims, 4 Drawing Sheets

PACKAGED ELECTRIC LAMP

BACKGROUND OF THE INVENTION

The invention relates to a packaged electric lamp comprising an electric lamp with an axis, provided with a lamp vessel and a lamp cap mounted to said vessel on said axis, a cardboard strip provided with a tag having a suspension opening, a window for inspecting the lamp vessel, and a first and a second end portion, the cardboard strip being folded around the lamp in the axial direction of the lamp, and the first and second end portions being fastened to one another.

Such a packed electric lamp is known from U.S. Pat. No. 4,385,694.

Packing of an electric lamp can be done by means of a so-called blister, a synthetic foil applied against a cardboard backing with the lamp in between. This packing can easily be presented hanging and offers the possibility of inspecting the lamp in the packing, but it has the drawback that the environment is polluted with plastic waste.

The packed electric lamp according to the U.S. Patent cited can also be presented hanging and inspected in the packing, which is important in the case of sale at self-service retail outlets, without synthetic packing material being used. The packing has the drawback, however, that it fixes the lamp insufficiently sideways. Another important drawback is that the lamp, while it is in its packing, cannot be inserted in the usual contact socket in order to check its operation. A further drawback is that it is difficult to hold the lamp while it is being provided with its packing mechanically.

Similar drawbacks are inherent in the packed lamp according to U.S. Pat. No. 4,390,097, for which a cardboard strip provided with transverse folding lines is used, and in the packed lamp according to U.S. Pat. No. 4,194,623. According to the latter patent, moreover, and according to French Patent No. 1,065,227 cited in it and the corresponding Great Britain No. 702,024, a strip is used which has no window at the front through which the lamp can be viewed.

According to U.S. Pat. No. 2,619,227 several lamps are packed in a first sleeve, from which the lamps project with their bulb necks and lamp caps to the exterior and which has perforation lines along which a section containing one lamp can be separated from the remainder each time. The first sleeve containing the lamps is included in its entirety in a second sleeve which is provided with a suspension opening. This packing is double-walled for the most part and consequently requires much material. To the front the lamps are completely obscured from view. They cannot be checked for operation without being taken from the second sleeve. The lamps in the sleeve are not protected against mutual collisions.

An angular sleeve containing several lamps which project from the sleeve to the exterior with their lamp caps is known from DE-OS No. 29 23 228. The sleeve is subdivided into longitudinal sections, each for one lamp, by means of perforations. The sleeve is designed for upright presentation and offers the lamps lateral fixation by means of bottom sections which are snapped inwards. The sleeve is not suitable for hanging presentation. Seen from the front, the sleeve completely hides the lamp vessels of the packed lamps from view. The sleeve has a complicated shape, with both convex and concave folds, while the application of the packing around the lamps is complicated as well. This is because, when a blank sheet is being folded around lamps, convex folds are to be made in the sheet for shaping the sleeve itself, while simultaneously concave folds are necessary for snapping the bottom sections inwards. This requires mutually opposing forces. If, on the other hand, the bottom sections are snapped inwards after the sleeve has been formed from a blank, the relevant sections have to be forced, which leads to dents, which weaken these sections and cause the fixation to be easily lost.

SUMMARY OF THE INVENTION

The invention has for its object to provide a packaged lamp of the type described in the opening paragraph which has, among other characteristics, a package which can be applied in a simple, convenient manner, which keeps the lamp securely fixed and which still allows testing of the lamp in the package.

According to the invention this object is achieved in that the cardboard strip has an opening through which the lamp cap projects axially, and in that on either side of the window there are tongues projecting to the interior which enclose the lamp laterally.

The lamp may be fixed to a substantial degree in the package already by the fact that the opening for the lamp cap is dimensioned on the small side. The inwardly projecting tongues have an additional fixing and buffering effect.

It is convenient for the manufacture of the package if the tongues are bent inwards from the window. They may then fill the entire window of the package blank, or may fill this window substantially. It is possible, however, for the tongues to be fastened to the cardboard strip.

The end portions of the strip may be situated in various places. In a favourable embodiment, they are in the immediate vicinity of the opening for the lamp cap. In this embodiment, the tag with the suspension opening may be integral with the strip.

However, it may be recommendable for the end portions to be at a distance from this opening, for example opposite this opening. In this embodiment, the lamp cap can be passed through the opening, which results in an assembly, which can then be held at the lamp cap. The strip can then be bent around the lamp vessel and the end portions can subsequently be interconnected. This embodiment has the advantage that the lamp offers support to the one end portion of the strip while the other end portion is being pressed against it and is fastened, for example with glue. Also in this embodiment, the tag with the suspension opening may be integral with the strip. In a variant of this and the previous embodiment, the tag with the suspension opening is attached. This variant has the advantage that identically shaped and printed strips can be used for lamps of various operating voltages and power ratings, but also, for example, of various shapes and/or colours, and that specific product information can be displayed on the tag.

It is favourable for the packed lamp to have a base at the end opposite the tag with the suspension opening, in particular a flat base. Not only does this make the packing suitable for upright presentation as well, but the base also offers the possibility of accommodating the bar code for product identification. For the same reason as discussed in connection with the tag with the suspension opening, it is favourable if the base is attached. Packings which are identical in all other respects will still be specific for the packed lamps.

In another embodiment, an attached tag with suspension opening has itself a sufficient surface area for accommodating a bar code which is specific for the packed lamp. Alternatively, the tag may have an adhesive strip for fastening to the cardboard strip, and for carrying the bar code, too.

The opening in the cardboard strip through which the lamp cap projects in axial direction and the tongues bent inwards from the window fix the lamp in the cardboard strip. As a result the window may have a shape which is a strongly stylized version of the lamp vessel of the packed electric lamp. The advantage of this is that the tongues bent inwards from the window may be connected to the cardboard strip along creases which have a length of, for example, more than 0.2 times, for example between 0.4 and 0.7 times the dimension of the window in the direction of the lamp axis. The result is that the tension in the tongues, and thus the degree to which they contribute to the fixation of the lamp, can be chosen.

The cardboard strip may be made of, for example, mini-corrugated cardboard or duplex paperboard, for example with a weight of 200–400 g/m$^2$. Such materials have a direction in which they have a greater rigidity than in a direction at right angles to the first one. This difference is caused by the direction of the wave and the orientation direction of the fibres in the material, respectively.

The tension in the tongues and their contribution to the fixation of the lamp in the cardboard strip can be made even greater if the direction of the greatest rigidity of the material of the cardboard strip is taken to be transverse to the direction of the lamp axis.

An embodiment in which this possibility is realised also renders it very easy to use a cardboard strip which is provided with external convex creases at right angles to the lamp axis. This strip in fact allows itself to be folded around the lamp very easily during packing of a lamp, since it is flexed easily around the creases thanks to the lower rigidity in axial direction. An advantage of this is that, the ease of processing remaining the same as in the case of a cardboard strip which is applied around a lamp by bending, a flat portion can be formed opposite the lamp cap. The lamp can then also be presented upright.

The possibility of viewing the packaged lamp through the window in the strip, in conjunction with the information applied on the packing material at the same side of the packaged lamp, in order to ascertain the characteristics of the lamp, is of great importance in view of the multitude of shapes, power ratings, operating voltages, and other characteristics, like light beam concentration, light colour, light scattering, etc., with which electric lamps are offered. It is important for this information to be offered on one side of the packaged lamp facing the customer. This is especially important if various lamps are presented suspended side by side from a panel and if there is no possibility of looking from the side into the cardboard strip folded around the lamp.

It is self-evident that the number of convex creases at right angles to the axial direction in a cardboard strip having such creases, as well as their relative locations are dependent on the shape and size of the lamp vessel of the lamp. On the other hand, lamps of various shapes but of similar sizes may be packed in identically shaped cardboard strips, the more so since the window in the strip may be stylized. Those skilled in the art are definitely capable of designing a cardboard strip which is a suitable variant for a given lamp.

In a favourable embodiment, two lamps are packed in a strip having two identical halves. The strip may in this case have a plane of symmetry, mirroring the strip halves, or an axis of symmetry, in which case the window in the one strip half is diametrically opposite to the window in the other strip half. The packed lamps then have a front and rear which are identical.

BRIEF DESCRIPTION OF THE DRAWING

Embodiments of the packaged electric lamp according to the invention are shown in the drawing figures, in which.

DESCRIPTION OF THE PREFERRED EMBODIMENTS

Figure 1:
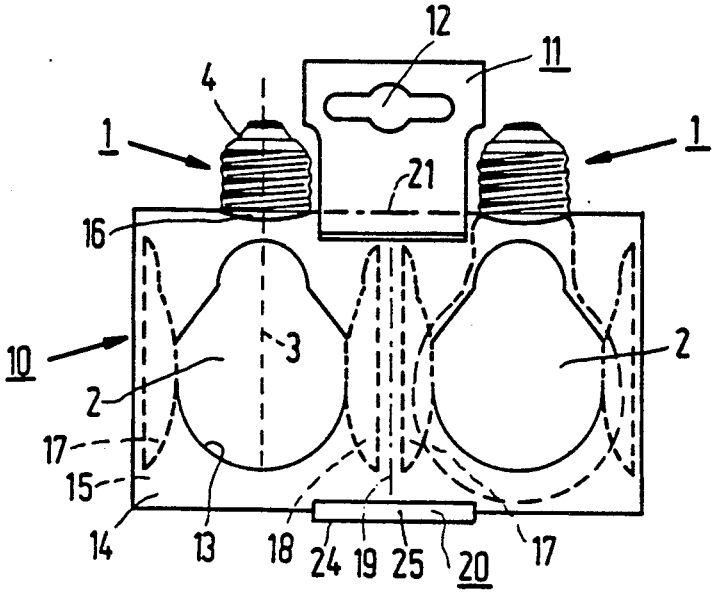
FIG. 1 is a first embodiment in front elevation.

In FIG. 1, a twin-pack holds two electric lamps 1 each comprising a lamp vessel 2, an axis 3, and a lamp cap 4 on said axis. A cardboard strip 10 is provided with a tag 11 having a suspension opening 12, a window 13 for each lamp 1 for inspecting the lamp vessel 2, and a first and a second end portion 14 and 15, respectively. The cardboard strip 10 is folded around the lamps 1 in the direction of the axis 3 of the lamps 1, while the first and second end portions 14, 15 opposite an opening 16 are fastened to one another.

The cardboard strip 10 has an opening 16 (see also FIG. 2*a*) for each lamp 1, through which opening the relevant lamp cap 4 projects axially, and, on either side of the relevant window 13, tongues 17, 18, which project to the interior and enclose the relevant lamp 1 laterally. Tongues 17, 18 form buffers between the lamps in the embodiments drawn. The tongues are bent inwards from the window 13. The strip 10 has two identical halves 10*a* and 10*b* and a plane of symmetry 19 parallel to the lamp axis 3. A separate base 20 is attached to the strip 10, as is the tag 11.

The strip 10 keeps the lamps 1 securely fixed. The windows 13 make it possible to inspect the lamp vessels 2 of the lamps. The openings 16 not only bring the lamp caps 4 into view, but also make them accessible for a contact socket in which the lamp caps can be inserted to check the lamp operation. For this purpose the tag 11 is folded to the front or rear around the crease 21.

Figure 2A:
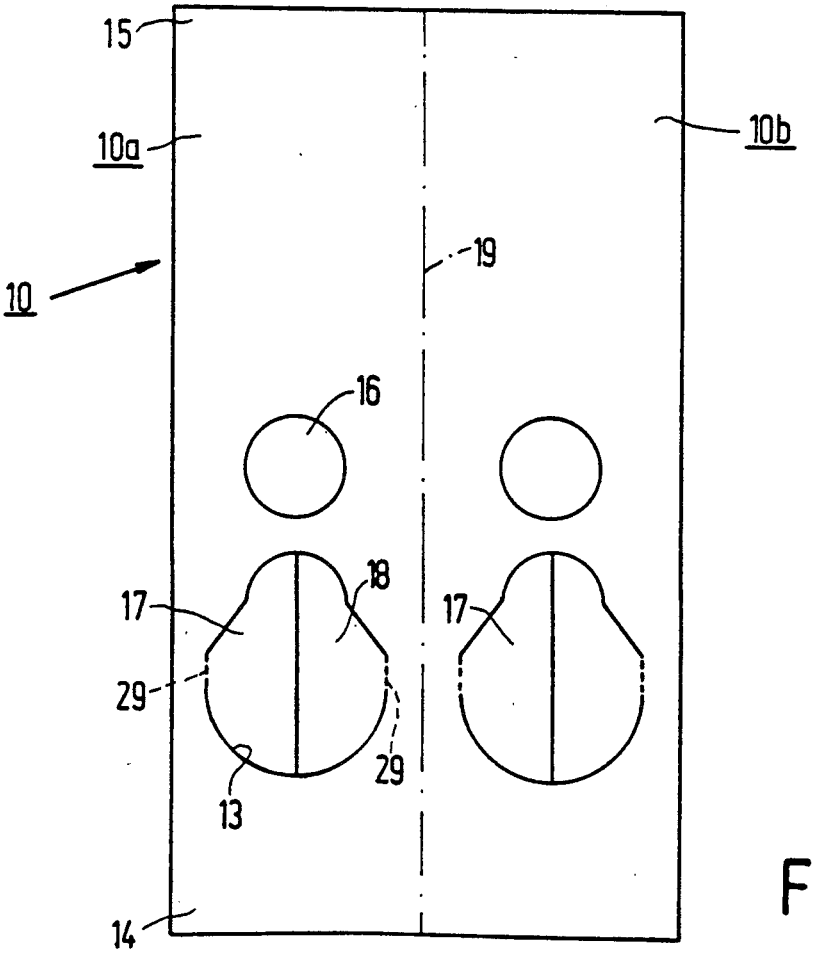
FIGS. 2*a, b, c* show the blanks of the packaged of FIG. 1.

FIG. 2*a* shows that the tongues 17, 18 are formed from the window 13 and together fill this window entirely. The window 13 is substantially in conformity with the contours of the lamp vessel 2 (FIG. 1). The creases 29 with which the tongues 17, 18 are connected to the cardboard strip 10, accordingly, are short in comparison with the dimensions of the window 13 in the direction of the axis 3 of the lamp vessel 2 (FIG. 1), i.e. in the longitudinal direction of the strip 10.

Figure 2B:
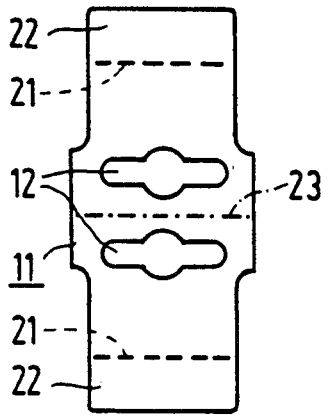

It is apparent from FIG. 2*b* that the tag 11 is of two-ply design, with a crease 23 between the halves. The tag has adhesive strips 22 for fastening to the cardboard strip 10, which adhesive strips are connected to the tag 11 along creases 21.

Figure 2C:
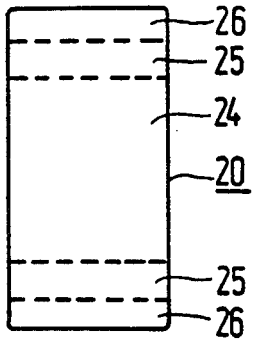

The base shown in FIG. 2*c* has a bottom section 24, upright sections 25, and adhesive strips 26.

Figure 3:
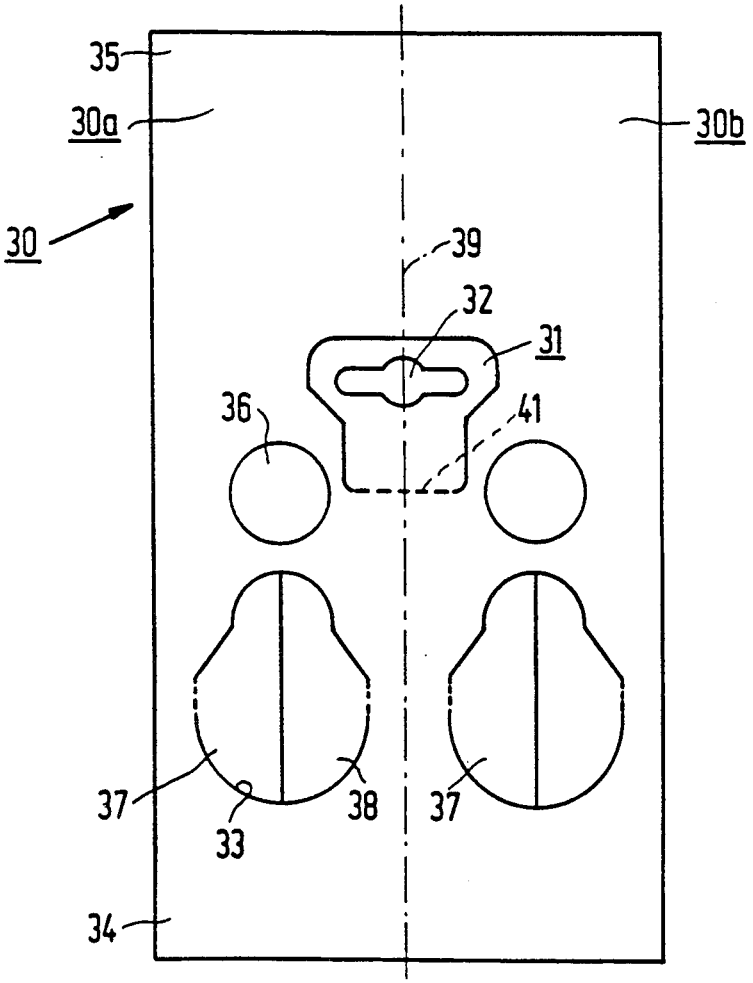
FIG. 3 is a second embodiment of a packaged blank.

In FIG. 3, parts corresponding to parts of FIG. 2 have reference numerals which are 20 higher than those in FIG. 2. The tag 31 with the suspension opening 32 is integral with the strip 30 and connected to the latter along a crease 41.

Figure 4:
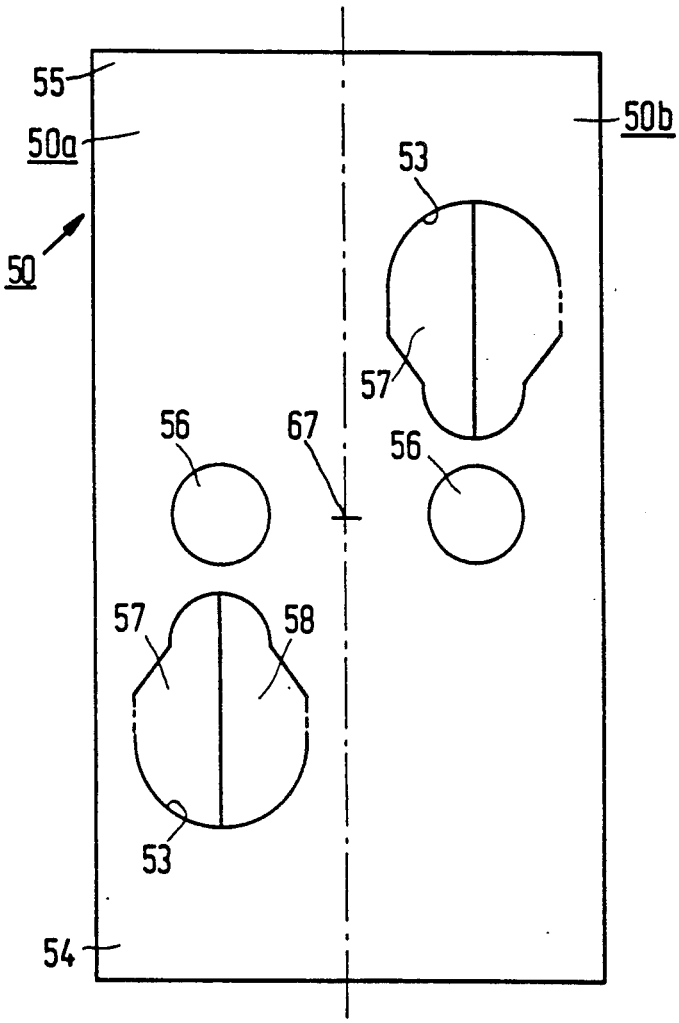
FIG. 4 is a third embodiment of a packaged blank.

In FIG. 4, parts corresponding to parts of FIG. 2 have reference numerals which are 40 higher than those in FIG. 2. The strip 50 has an axis of symmetry 67, as a consequence of which it yields a packaged lamp of which the front is identical to the rear.

Figure 5:
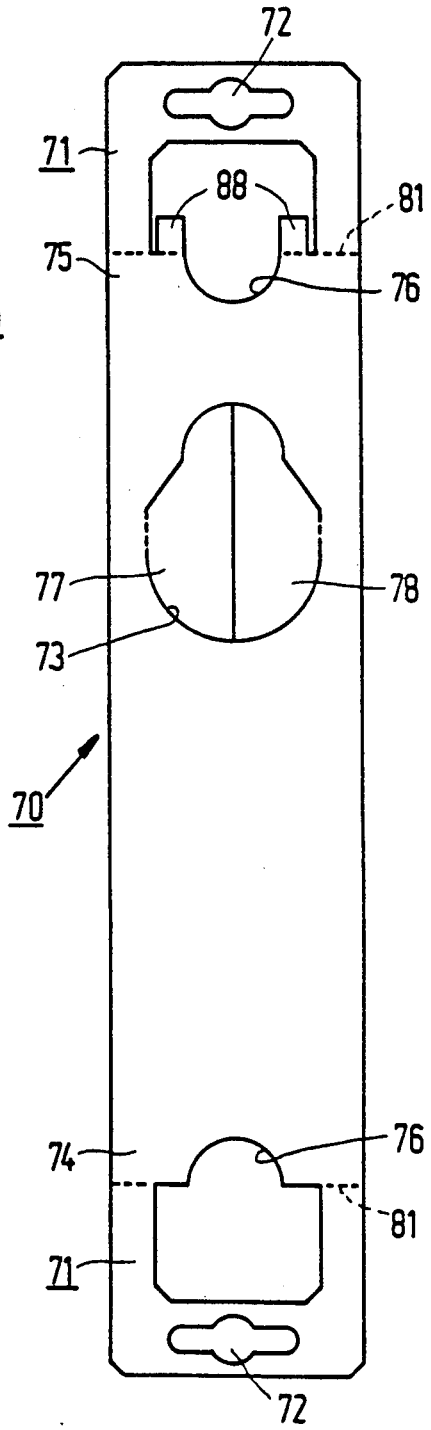
FIG. 5 is a fourth embodiment of a package blank.

The cardboard strip 70 of FIG. 5 is suitable for packaging one lamp. In this figure parts corresponding to parts of FIG. 2 have reference numerals which are 60 higher than those in FIG. 2. The end portions 74 and 75 in this embodiment are near the opening 76 for the lamp cap. The end portions can be interconnected by fixing the parts of the tag 71 to one another, but also by means of retaining tongues 88.

Figure 6:
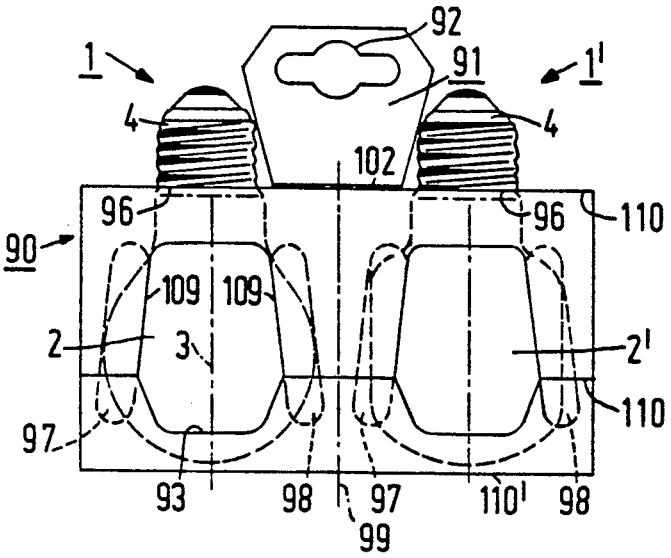
FIG. 6 is a further embodiment of a packaged lamp in front elevation.

In FIG. 6, parts corresponding to parts of FIG. 2 have reference numerals which are 80 higher than those in FIG. 2. In the cardboard strip 90, lamps 1, 1' are packed with identical lamp caps 4, but with differently shaped lamp vessels 2 and 2'. The cardboard strip 90 differs from the previous one in a number of respects. The windows 93 have the same, stylized shape. As a result, the tongues 97, 98 are connected to the cardboard strip 90 along creases 109 which have a great length in relation to the dimensions of the window 93 in the direction of the axis 3 of the lamp vessel 1 (approximately 0.65 times). This means that the tongues bear on the lamp vessel 1 with force. The cardboard strip 90 is cut from the material in such a way that the greatest rigidity of this material is in a direction transverse to the axis 3.

The cardboard strip 90 (see also FIG. 7) has a number of externally convex folds 110, 110' transverse to the axis 3 around which folds the strip is flexed. It is apparent from FIG. 7 that two folds 110' form a base 100 opposite the lamp cap 4, on which the lamp can stand.

The tongues 97 and 98 (see also FIG. 8) have rounded corners, so that they can only substantially fill the window 93. A comparison of FIG. 7 and FIG. 8 shows that lamps of dissimilar shape can be packed in one and the same cardboard strip.

Figure 7:
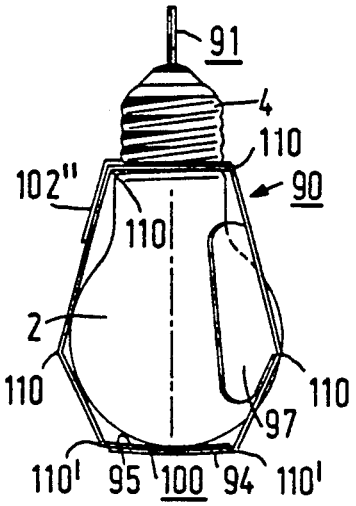
FIG. 7 shows the packaged lamp of FIG. 6 in a first side elevation.
Figure 9:
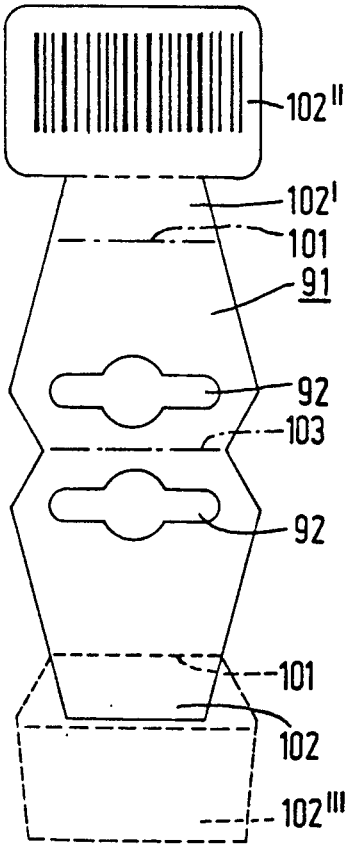
FIG. 9 shows the blank of part of the package of FIG. 6.
Figure 8:
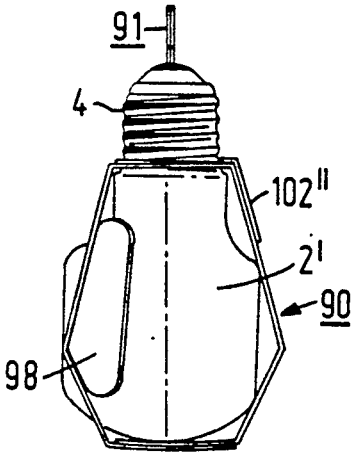
FIG. 8 shows the packaged lamp of FIG. 6 in a second side elevation.

Parts in FIG. 9 corresponding to the tag 91 with suspension opening 92 of the FIGS. 6–8 have reference numerals which are 80 higher than those in FIG. 2*b*. The adhesive strip 102', 102'' has a sufficiently large surface area for accommodating a bar code. The adhesive strip 102, too, may be designed with a similar size and extend as a strip 102''' to the vicinity of the window 93 (FIG. 6) in order to accommodate printed information about the packed lamp.

Figure 10:
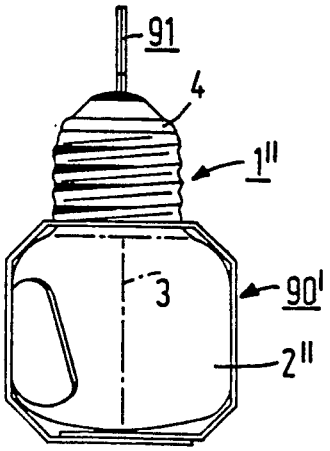
FIG. 10 is a variant of FIG. 7.

FIG. 10 shows a cardboard strip 90' which, compared with the strip shown in FIGS. 6–8 shows a considerable difference in dimensions because of the considerable difference in dimensions of the lamp vessel 2''.

We claim:

1. A package containing at least one electric lamp comprising a vessel disposed around an axis and a cap attached to the vessel on the axis, characterized in that the package comprises a cardboard strip folded around the at least one lamp and having first and second ends secured together, said package including:

a. oppositely disposed first and second sides adjacent corresponding surfaces of the lamp vessel of the at least one lamp, said package having an inspection opening in at least one of the sides for enabling inspection of said vessel;

b. first and second tongues disposed at opposing edges of the at least one inspection opening and extending into the package for inhibiting movement of said lamp in a direction transverse to said axis;

c. a third side having at least one opening through which the cap of the at least one lamp projects to facilitate electrical testing of the lamp without removal from the package; and d. a tag extending from one side of the package for enabling hanging of the package, said tag being configured and located on said package so as not to prevent said electrical testing.

2. A package as in claim 1 containing a single electric lamp.

3. A package as in claim 1 containing a plurality of electric lamps.

4. A package as in claim 3 where the lamps are disposed side-by-side with the axes of said lamps being substantially parallel to each other.

5. A package as in claim 1 where the first and second tongues are substantially parallel to the axis of the respective lamp.

6. A package as in claim 1 where the first and second tongues are an integral part of the cardboard strip and are bent into the package at creases along respective ones of the edges of the inspection opening.

7. A package as in claim 1 where the opening in the third side is remotely located with respect to the first and second ends.

8. A package as in claim 7 where the first and second ends are located in a portion of the package which is disposed opposite the third side.

9. A package as in claim 1 where the tag is attached to the cardboard strip.

10. A package as in claim 1 where the tag is an integral part of the cardboard strip.

11. A package as in claim 1 including a base attached to the cardboard strip for facilitating standing of the package.

12. A package as in claim 1 where the cardboard strip includes an integral portion shaped as a base for facilitating standing of the package.

13. A package as in claim 9 where the tag includes an adhesive strip affixed to the cardboard strip in the vicinity of at least one inspection opening.

14. A package as in claim 1 where the cardboard strip includes a plurality of folds extending transversely with respect to the axis of the at least one lamp vessel.

15. A package as in claim 14 where the cardboard strip is most rigid in the direction of the folds.

16. A package as in claim 14 where the cardboard strip forms an integral base in a portion disposed between two of said folds for facilitating standing of the package.

17. A package as in claim 6 where the crease has a length of at least 0.2 times a dimension of the respective inspection opening in the direction of the respective lamp vessel axis.

* * * * *